US006499471B2

(12) United States Patent
Shen et al.

(10) Patent No.: US 6,499,471 B2
(45) Date of Patent: Dec. 31, 2002

(54) HYDRAULIC COMPENSATOR FOR A PIEZOELECTRICAL FUEL INJECTOR

(75) Inventors: Jingming Jim Shen, Newport News, VA (US); Bogdan Gromek, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/870,998

(22) Filed: Jun. 1, 2001

(65) Prior Publication Data

US 2002/0179062 A1 Dec. 5, 2002

(51) Int. Cl.[7] ..... F02M 37/04
(52) U.S. Cl. ..... 123/498; 239/102.2
(58) Field of Search ..... 123/497, 498, 123/467; 239/102.2, 533.2, 533.3; 310/326, 327

(56) References Cited

U.S. PATENT DOCUMENTS

| | | | | |
|---|---|---|---|---|
| 4,022,166 A | | 5/1977 | Bart | 123/32 |
| 4,550,744 A | | 11/1985 | Igashira et al. | 137/80 |
| 4,584,980 A | | 4/1986 | Weiger et al. | 123/458 |
| 4,725,002 A | | 2/1988 | Trachte | 239/102.2 |
| 4,750,706 A | | 6/1988 | Schlagmuller | 251/129.06 |
| 5,186,151 A | | 2/1993 | Schwerdt et al. | 123/506 |
| 5,740,969 A | | 4/1998 | Hoffmann et al. | 239/533.2 |
| 5,810,255 A | | 9/1998 | Itoh et al. | 239/102.2 |
| 5,819,710 A | | 10/1998 | Huber | 123/498 |
| 5,875,764 A | * | 3/1999 | Kappel | 123/467 |
| 6,062,533 A | * | 5/2000 | Kappel | 251/57 |
| 6,079,636 A | | 6/2000 | Rembold et al. | 239/88 |
| 6,148,842 A | | 11/2000 | Kappel et al. | 137/79 |
| 6,313,568 B1 | * | 11/2001 | Sullivan et al. | 310/346 |

FOREIGN PATENT DOCUMENTS

| | | |
|---|---|---|
| DE | 43 06 072 C2 | 2/1993 |
| DE | 43 06 073 C1 | 2/1993 |
| DE | 44 06 522 C1 | 2/1994 |
| DE | 44 12 948 C2 | 4/1994 |
| DE | 195 04 175 C2 | 2/1995 |
| DE | 195 29 667 C2 | 8/1995 |
| DE | 197 27 992 A1 | 7/1997 |
| DE | 197 50 149 A1 | 11/1997 |
| DE | 198 04 196 A1 | 2/1998 |
| DE | 198 34 461 A1 | 7/1998 |
| DE | 198 34 673 A1 | 7/1998 |
| DE | 198 36 561 A1 | 8/1998 |
| DE | 198 38 862 A1 | 8/1998 |
| DE | 198 57 338 C1 | 12/1998 |
| DE | 199 52 946 A1 | 11/1999 |
| EP | 0 795 081 B1 | 11/1995 |
| WO | 98/44256 | 10/1998 |

* cited by examiner

*Primary Examiner*—Thomas N. Moulis

(57) ABSTRACT

A fuel injector comprises a body having a longitudinal axis, a piezoelectric actuator that has first and second ends, a needle coupled to the first end of the piezoelectric actuator, and a hydraulic compensator coupled the second end of the piezoelectric actuator. The piezoelectric actuator includes a plurality of piezoelectric elements along the axis between the first and second ends. The needle is movable between a first configuration permitting fuel injection and a second configuration preventing fuel injection. And the hydraulic compensator axially positions the piezoelectric actuator with respect to the body in response to temperature variation. Also, a method of compensating for thermal expansion or contraction of the fuel injector comprises providing fuel from a fuel supply to the fuel injector; and axially adjusting the piezoelectric actuator with respect to the body in response to temperature variation. The axially adjusting includes moving hydraulic oil through an orifice connecting first and second hydraulic oil reservoirs.

16 Claims, 4 Drawing Sheets

HYDRAULIC COMPENSATOR FOR A PIEZOELECTRICAL FUEL INJECTOR

FIELD OF THE INVENTION

The invention generally relates to piezoelectric strain actuators. In particular, the present invention relates to a hydraulic compensator for a piezoelectric actuator, and more particularly to an apparatus and method for hydraulically compensating a piezoelectrically actuated high-pressure fuel injector for internal combustion engines.

BACKGROUND OF THE INVENTION

It is believed that a known piezoelectric actuator is includes a ceramic structure whose axial length can change through the application of an operating voltage. It is believed that in typical applications, the axial length can change by, for example, approximately 0.12%. In a stacked configuration, it is believed that the change in the axial length is magnified as a function of the number of actuators in the piezoelectric actuator stack. Because of the nature of the piezoelectric actuator, it is believed that a voltage application results in an instantaneous expansion of the actuator and an instantaneous movement of any structure connected to the actuator. In the field of automotive technology, especially, in internal combustion engines, it is believed that there is a need for the precise opening and closing of an injector valve element for optimizing the spray and combustion of fuel. Therefore, in internal combustion engines, it is believed that piezoelectric actuators are now employed for the precise opening and closing of the injector valve element.

During operation, it is believed that the components of an internal combustion engine experience significant thermal fluctuations that result in the thermal expansion or contraction of the engine components. For example, it is believed that a fuel injector assembly includes a valve body that may expand during operation due to the heat generated by the engine. Moreover, it is believed that a valve element operating within the valve body may contract due to contact with relatively cold fuel. If a piezoelectric actuator stack is used for the opening and closing of an injector valve element, it is believed that the thermal fluctuations can result in valve element movements that can be characterized as an insufficient opening stroke, or an insufficient sealing stroke. It is believed that this is because of the low thermal expansion characteristics of the piezoelectric actuator as compared to the thermal expansion characteristics of other engine components. For example, it is believed that a piezoelectric actuator stack is capable of 30 microns of movement and that a valve element is capable of contracting 10 microns due to temperature fluctuations, in which case the piezoelectric actuator stack loses 30% of its overall movement. Therefore, it is believed that any contractions or expansions, of a valve element can have a significant effect on fuel injector operation.

It is believed that conventional methods and apparatuses that compensate for thermal changes affecting piezoelectric actuator stack operation have drawbacks in that they either only approximate the change in length, they only provide one length change compensation for the piezoelectric actuator stack, or that they only accurately approximate the change in length of the piezoelectric actuator stack for a narrow range of temperature changes.

It is believed that there is a need to provide thermal compensation that overcomes the drawbacks of conventional methods.

SUMMARY OF THE INVENTION

The present invention provides a fuel injector. The fuel injector comprises a body having a longitudinal axis, a piezoelectric actuator that has first and second ends, a needle coupled to the first end of the piezoelectric actuator, and a hydraulic compensator coupled the second end of the piezoelectric actuator. The piezoelectric actuator includes a plurality of piezoelectric elements along the axis between the first and second ends. The needle is movable between a first configuration permitting fuel injection and a second configuration preventing fuel injection. And the hydraulic compensator axially positions the piezoelectric actuator with respect to the body in response to temperature variation.

The present invention also provides a method of compensating for thermal expansion or contraction of a fuel injector. The fuel injector includes a body that has a longitudinal axis, a piezoelectric actuator that has first and second ends, a needle coupled to the first end of the piezoelectric actuator, and a hydraulic compensator coupled the second end of the piezoelectric actuator. The piezoelectric actuator includes a plurality of piezoelectric elements along the axis between the first and second ends. The needle is movable between a first configuration permitting fuel injection and a second configuration preventing fuel injection. The method comprises providing fuel from a fuel supply to the fuel injector; and axially adjusting the piezoelectric actuator with respect to the body in response to temperature variation. The axially adjusting includes moving hydraulic oil through an orifice connecting the first and second reservoirs.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
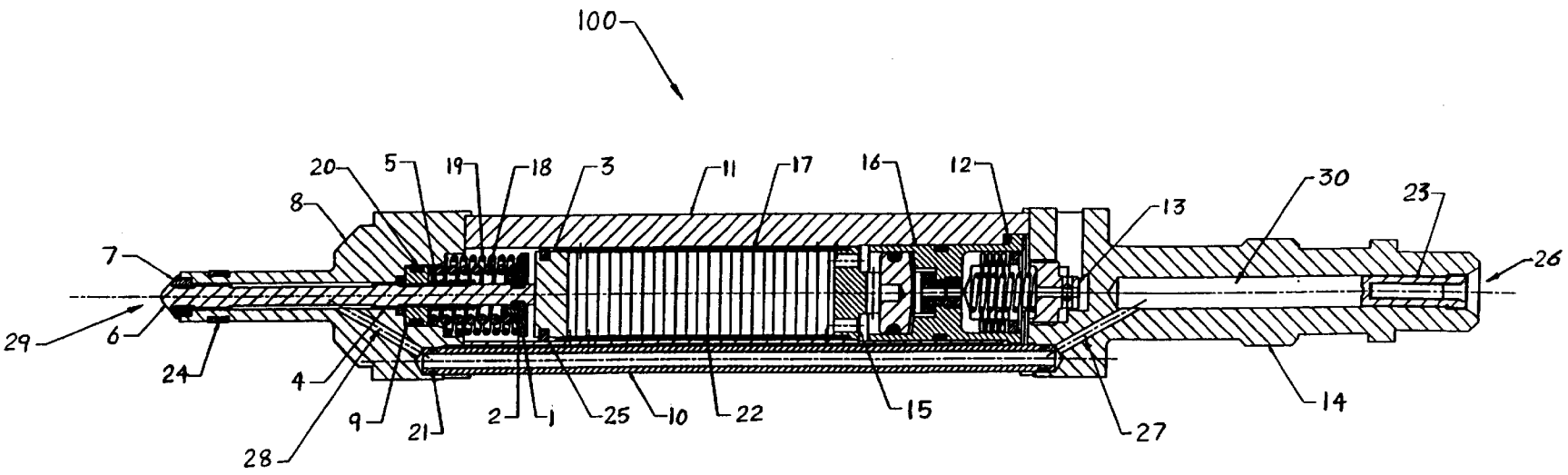
FIG. 1 is a cross-sectional view of a fuel injector assembly having a piezoelectric actuator stack and a hydraulic compensator unit.

FIG. 1 is a cross-sectional view of a fuel injector assembly 100 having a piezoelectric actuator stack 22 and a hydraulic compensator assembly 16.

The fuel injector assembly 100 includes inlet cap 14, injector housing 11, and valve body 8. The inlet cap 14 includes a fuel filter 23, fuel passageways 27 and 30, and a fuel inlet 26 connected to a fuel source (not shown).

Injector housing 11 encloses the piezoelectric actuator stack 22 and the hydraulic compensator assembly 16. Valve body 8 is fixedly connected to injector housing 11 and encloses a valve needle 6.

The piezoelectric actuator stack 22 includes a plurality of piezoelectric actuators that can be operated through contact pins (not shown) that are electrically connected to a voltage source. When a voltage is applied between the contact pins (not shown), the piezoelectric actuator stack 22 expands in a lengthwise direction. A typical expansion of the piezoelectric actuator stack 22 may be on the order of approximately 30 microns, for example. The lengthwise expansion can be utilized for operating the injection valve needle 6 for the fuel injector assembly 100.

Figure 4:
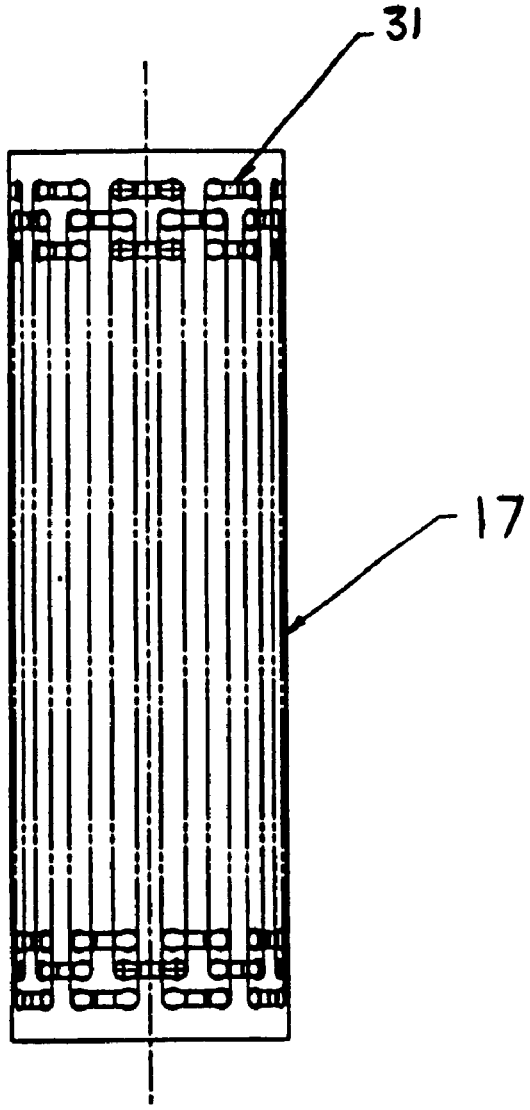
FIG. 4 is an enlarged view of a tube spring for a piezoelectric stack.

FIG. 4 is an enlarged view of a tube spring 17 for pre-compressing the piezoelectric actuator stack 22. Tube spring 17 prevents the piezoelectric actuator stack 22 from being placed in tension and thus cracking. Tube spring 17 has holes 31 uniformly distributed over its entire surface. The holes 31 are of a "dumb-bell" shape and run through the tube spring 17 at right angles relative to the axis of the spring. The holes 31 provide assurance that the tube spring 17 has sufficient elasticity for allowing for elongation of the piezoelectric actuator stack 22 and that the tube spring 17 has a negligible interference on the elongation characteristics of the piezoelectric actuator stack 22. The elasticity of the tube spring 17 can be adjusted by the number and size of the holes 31 to permit a desired elongation of the biased piezoelectric actuator stack 22. Tube spring 17 is made preferably from spring steel, which has excellent high strength characteristics. Alternatively, other materials, such as materials with a low elasticity modulus (e.g., copper-beryllium alloys), can be used as well for tube spring 17.

Piezoelectric actuator stack 22 is guided along housing 11 by means of guides 25. The piezoelectric actuator stack 22 has a first end in operative contact with valve needle 6 by means of bottom 3, and a second end that is operatively connected to hydraulic compensator assembly 16 by means of a top 15.

Fuel injector assembly 100 further includes an inner spring 18, an outer spring 19, a spring washer 1, a keeper 2, a bushing 4, a lower bellows 5, a valve needle seat 7, a bellows weld ring 9, and an O-ring 20. O-ring 20 may be preferably an "Apple" type O-ring. Nested inner and outer springs 18 and 19, respectively, allow for a relatively high spring factor and small overall spring diameter as compared to a single spring with the same overall spring factor.

Figure 2:
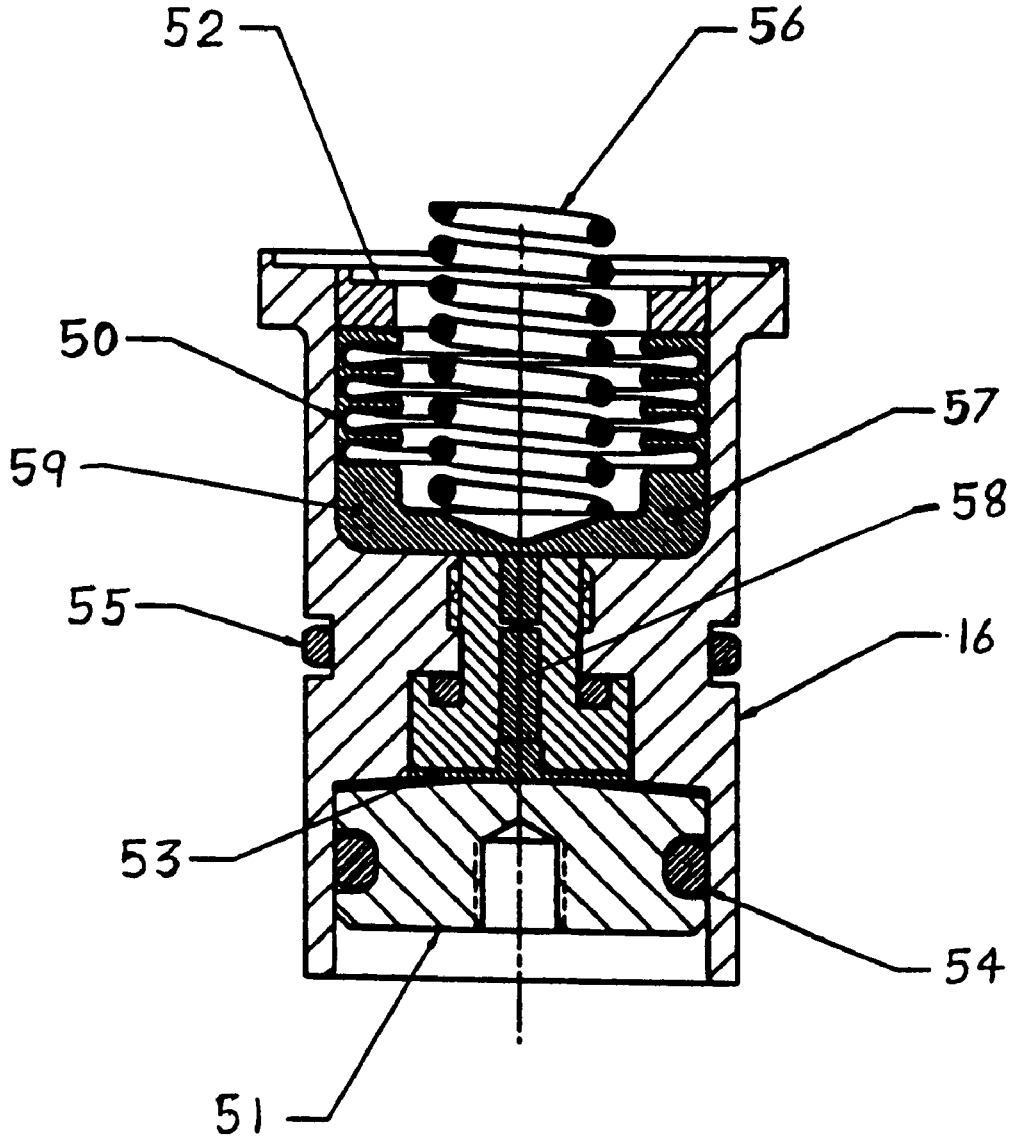
FIG. 2 is an enlarged view of an embodiment a hydraulic compensator assembly.

FIG. 2 is an enlarged view of a first embodiment of a hydraulic compensator assembly 16. Hydraulic compensator assembly 16 includes a bellows 50, a piston 51, a bellows weld ring 52, an orifice screw 53, O-rings 54 and 55, a compression spring 56, hydraulic oil 57, an orifice 58 and a supply reservoir 59. O-ring 54 may be a "Parker" type O-ring, and O-ring 55 may be an "Apple" type O-ring. Bellows 50 may be used in the hydraulic compensator assembly 16 because of its superior wear-resistant properties as compared to an O-ring. Piston 51 can be operatively connected to top 15 of piezoelectric actuator stack 22 so that any axial translation of piston 51 is directly transmitted to piezoelectric actuator stack 22. Hydraulic oil 57 may be Silicon oil, but can alternately be any type of fluid with similar fluid properties, e.g., substantially non-compressible.

During operation of the first embodiment of the hydraulic compensator 16, fuel is introduced at fuel inlet 26 from a fuel supply (not shown). Fuel at fuel inlet 26 passes through a fuel filter 23, through a passageway 30, through a passageway 27, through a fuel tube 10, through a passageway 28, and out through a fuel outlet 29 when valve needle 6 is moved to an open configuration.

In order for fuel to exit through fuel outlet 29, voltage is supplied to piezoelectric actuator stack 22 causing it to expand. The expansion of piezoelectric actuator stack 22 causes bottom 3 to push against valve needle 6 and allow fuel to exit the fuel outlet 29. After fuel is injected through fuel outlet 29, the voltage supply to piezoelectric actuator stack 22 is terminated and valve needle 6 is returned under the bias of inner and outer springs 18 and 19, respectively, to close fuel outlet 29. Specifically, the piezoelectric actuator stack 22 contracts when the voltage supply is terminated, and the bias of the inner and outer springs 18,19, which hold the valve needle 6 in constant contact with bottom 3, also biases the valve needle 6 to the closed configuration.

During engine operation, as the temperature in the engine rises, inlet cap 14, injector housing 11 and valve body 8 experience thermal expansion due to the rise in temperature. At the same time, fuel traveling through fuel tube 10 and out through fuel outlet 29 cool the internal components of fuel injector assembly 100 and cause thermal contraction of valve needle 6. Referring to FIGS. 1 and 2, as valve needle 6 contracts, bottom 3 tends to separate from its contact point with valve needle 6. Piezoelectric actuator stack 22, which is operatively connected to the bottom surface of piston 51, is pushed downward by means of piston 51 of hydraulic compensator 16. The increase in temperature causes inlet cap 14, injector housing 11 and valve body 8 to expand and cause further compression of compression spring 56. The compression force on compression spring 56 is transferred to hydraulic oil 57 by means of upper bellows 50. Thus, hydraulic oil 57 is pushed from supply reservoir 59, down through orifice 58, to a working reservoir that forms a "shim" of hydraulic oil against the bottom end of orifice screw 53 and against the top surface of piston 51. Because of the virtual incompressibility of hydraulic oil and the relatively small diameter of orifice 58 (approximately 30 microns), the "shim" of hydraulic oil against the top surface of piston 51 acts as a substantially solid structure and thus maintains the axial orientation of piston 51 during subsequent energizing or de-energizing of piezoelectric actuator stack 22.

During subsequent fluctuations in temperature around the fuel injector assembly 100, any further expansion or contraction of inlet cap 14, injector housing 11 and valve body 8 causes the hydraulic oil 57 to travel from or into reservoir 59, through orifice 58. Thus bottom 3 is maintained in constant contact with the contact surface of valve needle 6.

Figure 3:
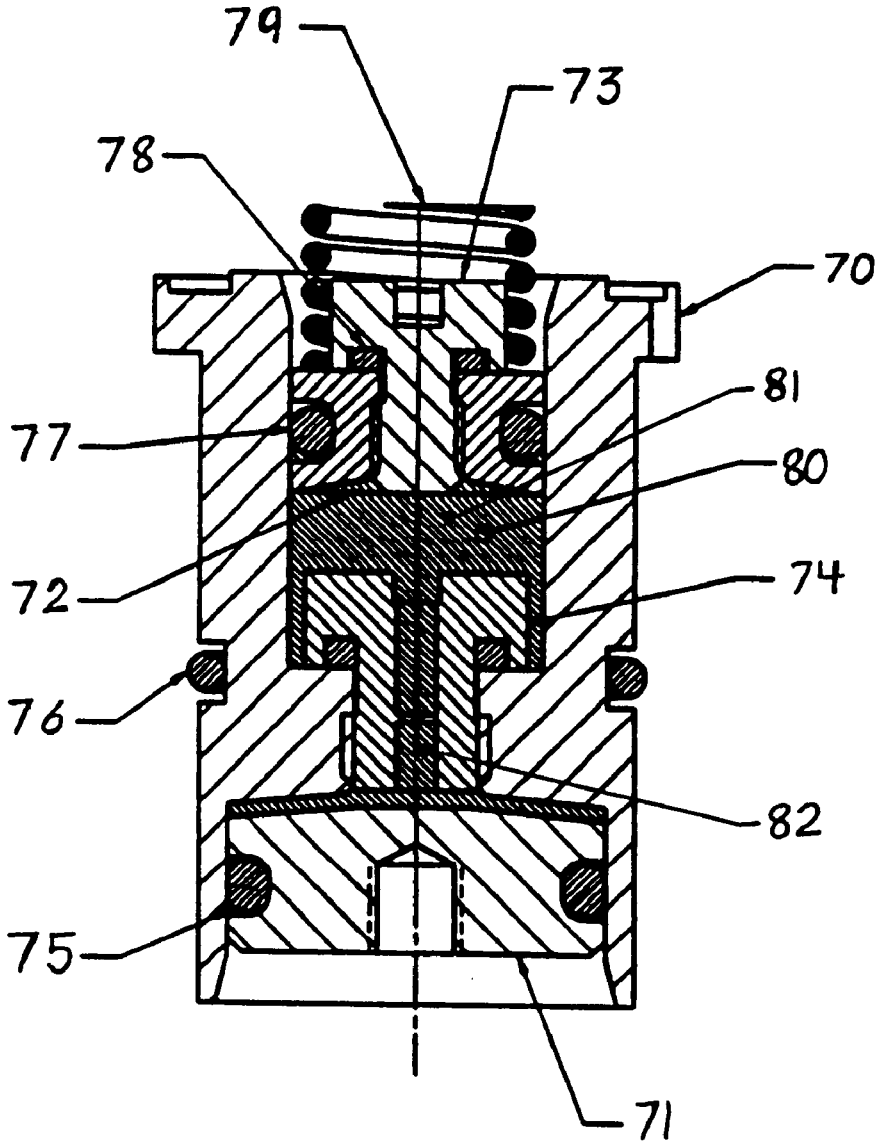
FIG. 3 is an enlarged view of an alternative embodiment of a hydraulic compensator assembly.

FIG. 3 is an enlarged view of a second embodiment of a hydraulic compensator assembly 70 according to the present invention. Hydraulic compensator assembly 70 includes a piston 71, a back-up piston 72, a plug 73, an orifice screw 74, O-rings 75–78, a compression spring 79, hydraulic oil 80, a supply reservoir 81, and an orifice 82. O-rings 75 and 77 may be preferably "Parker" type O-rings, and O-rings 76 and 79 may be preferably "Apple" type O-rings. Piston 71 can be operatively connected to top 15 of piezoelectric actuator stack 22 so that any axial translation of piston 71 is directly transmitted to piezoelectric actuator stack 22. Hydraulic oil 80 may be Silicon oil, but can alternately be any type of fluid with similar fluid properties, e.g., substantially non-compressible.

During operation of the second embodiment of the hydraulic compensator 70, fuel is introduced to the fuel inlet 26 from a fuel supply (not shown). Fuel at fuel inlet 26 passes through fuel filter 23, through passageway 30, through passageway 27, through fuel tube 10, through passageway 28 and out through fuel outlet 29 when valve needle 6 is moved to the open configuration.

In order for fuel to exit through fuel outlet 29, voltage is supplied to piezoelectric actuator stack 22 causing it to expand. The expansion of piezoelectric actuator stack 22 causes attached bottom 3 to push against valve needle 6 and allow fuel to exit the fuel outlet 29. Upon fuel release through fuel outlet 29, the voltage supply to piezoelectric actuator stack 22 is terminated and valve needle 6 is returned to its original position to close fuel outlet 29 under the bias of inner and outer springs 18,19. Specifically, the piezoelectric actuator stack 22 contracts when the voltage supply is terminated, and the bias of the inner and outer springs 18,19, which hold the valve needle 6 in constant contact with bottom 3, also biases the valve needle 6 to the closed configuration.

During engine operation, as the temperature in the engine rises, inlet cap 14, injector housing 11 and valve body 8 experience thermal expansion due to the rise in temperature. At the same time, fuel traveling through fuel tube 10 and out through fuel outlet 29 cool the internal components of fuel injector assembly 100 and cause thermal contraction of valve needle 6. Referring to FIGS. 1 and 3, as valve needle 6 contracts, bottom 3 tends to separate from its contact point with valve needle 6. Piezoelectric actuator stack 22, which is operatively connected to the bottom surface of piston 71, is pushed downward by means of piston 71 of hydraulic compensator 70. The increase in temperature causes inlet cap 14, injector housing 11 and valve body 8 to expand and cause further compression of compression spring 79. The compression force on compression spring 79 is transferred to hydraulic oil 80 by means of back-up piston 72. Thus, hydraulic oil 80 is pushed from reservoir 81 down through orifice 82 to a working reservoir that forms a "shim" of hydraulic oil against the top surface of piston 71. Thus, as compared to the first embodiment, instead of using a bellows to push the hydraulic oil out of the reservoir, the alternate embodiment of FIG. 3 uses a "Parker" type O-ring 77 and a back-up piston 72 to push hydraulic oil 80 through orifice 82. Because of the virtual incompressibility of hydraulic oil and the relatively small diameter of orifice 82 (approximately 30 microns), the "shim" of hydraulic oil against the top surface of piston 71 acts as a substantially "solid" rest structure and thus maintains the axial orientation of piston 71 during subsequent energizing or de-energizing of piezoelectric actuator stack 22.

During subsequent fluctuations in temperature around the fuel injector assembly 100, any further expansion or contraction of inlet cap 14, injector housing 11 and valve body 8 causes the high viscosity hydraulic oil 80 to travel from or into reservoir 81, through orifice 82. Thus bottom 3 is maintained in constant contact with the contact surface of valve needle 6.

Referring also to FIG. 1, fuel injector assembly 100 further includes a crush ring 12 and an adjusting screw 13. Crush ring 12 adjusts the axial positioning of hydraulic compensator assembly 16 (or 70) relative to the housing 11. Adjusting screw 13 allows pre-adjustment of the axial location of hydraulic compensator assembly 16 (or 70) relative to piezoelectric actuator stack 17, as well as pre-adjustment of the spring factor of compression spring 56 (or 79).

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector comprising:

a body having a longitudinal axis;

a piezoelectric actuator having first and second ends, the piezoelectric actuator including a plurality of piezoelectric elements along the axis between the first and second ends;

a needle coupled to the first end of the piezoelectric actuator, the needle being movable between a first configuration permitting fuel injection and second configuration preventing fuel injection; and a hydraulic compensator coupled to the second end of the piezoelectric actuator and axially positioning the piezoelectric actuator with respect to the body in response to temperature variation, the hydraulic compensator comprises:

hydraulic oil;

a first reservoir filled with the hydraulic oil;

a second reservoir filled with the hydraulic oil;

an orifice connecting the first and second reservoirs, the hydraulic oil moving through the orifice between the reservoirs in response to temperature variation.

2. The fuel injector according to claim 1, wherein the hydraulic oil comprises silicon oil.

3. The fuel injector according to claim 1, wherein the hydraulic compensator further comprises:

a first piston fixed with respect to the second end of the piezoelectric actuator stack, the piston defines a portion of the first reservoir.

4. The fuel injector according to claim 3, wherein the hydraulic compensator further comprises:

a bellows defining at least a portion of the second reservoir; and a compression spring acting on the bellows to displace the hydraulic oil from the second reservoir, through the orifice, to the first reservoir, and to the first reservoir for displacing the first piston.

5. The fuel injector according to claim 4, wherein the hydraulic compensator further comprises:

a screw operatively connected to the compression spring and adjusting a spring factor of the compression spring.

6. The fuel injector according to claim 3, wherein the hydraulic compensator further comprises:

a second piston defining a portion of the second reservoir; and a compression spring acting on the second piston to displace the hydraulic oil from the second reservoir, through the orifice, and to the first reservoir for displacing the first piston.

7. The fuel injector according to claim 6, wherein the hydraulic compensator further comprises:

a screw operatively connected to the compression spring and adjusting a spring factor of the compression spring.

8. The fuel injector according to claim 1, wherein the orifice comprises a diameter that permits the hydraulic oil to move from the second resevoir to the first reservoir in response to temperature variation during thermal expansion of the fuel injector body and substantially prevents the hydraulic oil to move from the first resevoir to the second reservoir in response to movement due to actuation of the piezoelectric actuator.

9. The fuel injector according to claim 1, wherein the piezoelectric actuator is substantially unaffected by the temperature variation.

10. A method of compensating for thermal expansion or contraction of a fuel injector, the fuel injector a body having a longitudinal axis, a piezoelectric actuator having first and second ends, the piezoelectric actuator including a plurality of piezoelectric elements along the axis between the first and second ends, a needle coupled to the first end of the piezoelectric actuator, the needle being movable between a first configuration permitting fuel injection and a second configuration preventing fuel injection, and a hydraulic compensator coupled the second end of the piezoelectric actuator, the method comprising:

providing fuel from a fuel supply to the fuel injector; and axially adjusting the piezoelectric actuator with respect to the body in response to temperature variation, the axially adjusting including moving hydraulic oil through an orifice connecting the first and second reservoirs.

11. The method according to claim 10, wherein the axially adjusting comprises displacing a piston defining a portion of the first reservoir, and the piston displacing the second end of the piezoelectric actuator with respect to the body.

12. The method according to claim 11, wherein the axially adjusting further comprises compressing a spring operatively engaging a bellows, the bellows defining at least a portion of the second reservoir.

13. The method according to claim 12, wherein the axially adjusting further comprises adjusting a spring factor of the spring.

14. The method according to claim 11, wherein the axially adjusting further comprises compressing a spring operatively engaging a second piston, the second piston defining a portion of the second reservoir.

15. The method according to claim 14, wherein the axially adjusting further comprises adjusting a spring factor of the spring.

16. The method according to claim 10, the method further comprising:

substantially preventing the hydraulic oil to move between the first and second reservoirs in response to actuation of the piezoelectric actuator.

* * * * *